US006259434B1

(12) United States Patent
Tsai

(10) Patent No.: US 6,259,434 B1
(45) Date of Patent: Jul. 10, 2001

(54) TACTUALLY-ACTIVATED STRUCTURE

(75) Inventor: Ching Cheng Tsai, Keelung (TW)

(73) Assignee: Chicony Electronics Co., Ltd., Taipei Hsien (TW)

( * ) Notice: Subject to any disclaimer, the term of this patent is extended or adjusted under 35 U.S.C. 154(b) by 0 days.

(21) Appl. No.: 09/225,716

(22) Filed: Jan. 6, 1999

(51) Int. Cl.[7] ..... G09G 5/00

(52) U.S. Cl. ..... 345/168; 463/36; 463/37; 200/5 A; 200/5 R; 200/243; 84/719

(58) Field of Search ..... 345/168–172; 463/36, 37; 84/719, 720, 743, 744; 380/52; 200/243–245, 344, 5 A, 5 R

(56) References Cited

U.S. PATENT DOCUMENTS 3,988,551 * 10/1976 Larson ..... 200/5
4,354,068 * 10/1982 Sobol, III ..... 200/5 A
4,527,030 * 7/1985 Oelsch ..... 200/306
4,596,912 * 6/1986 Hattori ..... 200/302.2
4,760,217 * 7/1988 Suzuki et al. ..... 200/5 A
5,799,772 * 9/1998 Sanda et al. ..... 200/344
5,874,700 * 2/1999 Hochgesang ..... 200/515
5,894,039 * 4/1999 Tsai et al. ..... 427/555
5,955,690 * 9/1999 Yoshinaga ..... 84/437
5,981,890 * 11/1999 Chen ..... 200/515
6,191,776 * 2/2001 Hu ..... 345/168

* cited by examiner

*Primary Examiner*—Bipin Shalwala
*Assistant Examiner*—Jimmy H. Nguyen
(74) *Attorney, Agent, or Firm*—Rosenberg, Klein & Lee

(57) ABSTRACT

An elastic and tactually-activated structure is applicable to keyboard and comprises a dome-shaped elastic member having a plurality of vent holes arranged on the bottom side thereof and separated with a predetermined distance. The inventive structure further comprises a hard film having an opening corresponding to the location of key of the keyboard, and the bottom end of the elastic member which has a larger diameter being attached upon the opening. The elastic and tactually-activated structure is placed upon the conductive film of the key and the cap of the key is placed upon the top end of the elastic member which has a smaller diameter. When the cap is suppressed, the elastic member is compressed accordingly such that the bump of the elastic member will pass through the opening of the hard film and touch the contact and circuit on the conductive film. The key is therefore formed a closed circuit. In the present invention, the elastic member is directly attached on the hard film, thus simplifying the assembling process and preventing the random bounce of the elastic and tactually-activated structure.

2 Claims, 5 Drawing Sheets

TACTUALLY-ACTIVATED STRUCTURE

FIELD OF THE INVENTION

The present invention relates to an elastic and actually-activated structure which comprises a dome-shaped elastic body bound on a hard thin film, whereby the elastic and actually-activated body will not bounce undesirably when being placed between the conductive thin film and the cap of keyboard.

BACKGROUND OF THE INVENTION

As shown in FIG.4, the key of conventional keyboard generally comprises base plate 71, conductive film 72, elastic member 73, frame 74 and cap 75. The elastic member 73 is generally of dome shape and abuts the cap 75 and the conductive film 72 on top end and bottom end thereof, respectively. The pressing on the cap 75 will compress the elastic member 73 and enable the connection between the contact of the conductive film 72 and the corresponding circuit. However, the elasticity of the elastic member 73 makes it wont to bounce randomly, the assembling thereof is time-consuming and troublesome.

As shown in FIG. 5, another conventional elastic member comprises a dome-shaped elastic member 82 integrally formed with a soft film 81. The soft film 81 is assembled on a conductive film 83. This kind of elastic member has the advantages of easy and fast assembly. However, the elastic member is liable to twist due to the flexibility thereof. The positioning of the elastic member will be influenced if it is twisted.

It is on object of the present invention to provide an improved elastic and actually-activated structure for computer keyboard, which can be stably arranged on keyboard and has not the problem of random bounce.

It is another object of the present to provide an improved elastic and tactually-activated structure which is applicable to keyboard of various specification and does not require additional molding process, thus reducing cost.

To achieve above objects, the present invention provides an elastic and tactually-activated structure which is applicable to keyboard and comprises a dome-shaped elastic member having a plurality of vent holes arranged on the bottom side thereof and separated with a predetermined distance. The inventive structure further comprises a hard film having an opening corresponding to the location of key of the keyboard, and the bottom end of the elastic member which has a larger diameter being attached upon the opening. The elastic and actually-activated structure is placed upon the conductive film of the key and the cap of the key is placed upon the top end of the elastic member which has a smaller diameter. When the cap is suppressed, the elastic member is compressed accordingly such that the bump of the elastic member will pass through the opening of the hard film and touch the contact and circuit on the conductive film. The key is therefore formed a closed circuit. In the present invention, the elastic member is directly attached on the hard film, thus simplifying the assembling process and preventing the random bounce of the elastic and tactually-activated structure.

The various objects and advantages of the present invention will be more readily understood from the following detailed description when read in conjunction with the appended drawing, in which:

DETAIL DESCRIPTION OF PREFERRED EMBODIMENT

Figure 1:
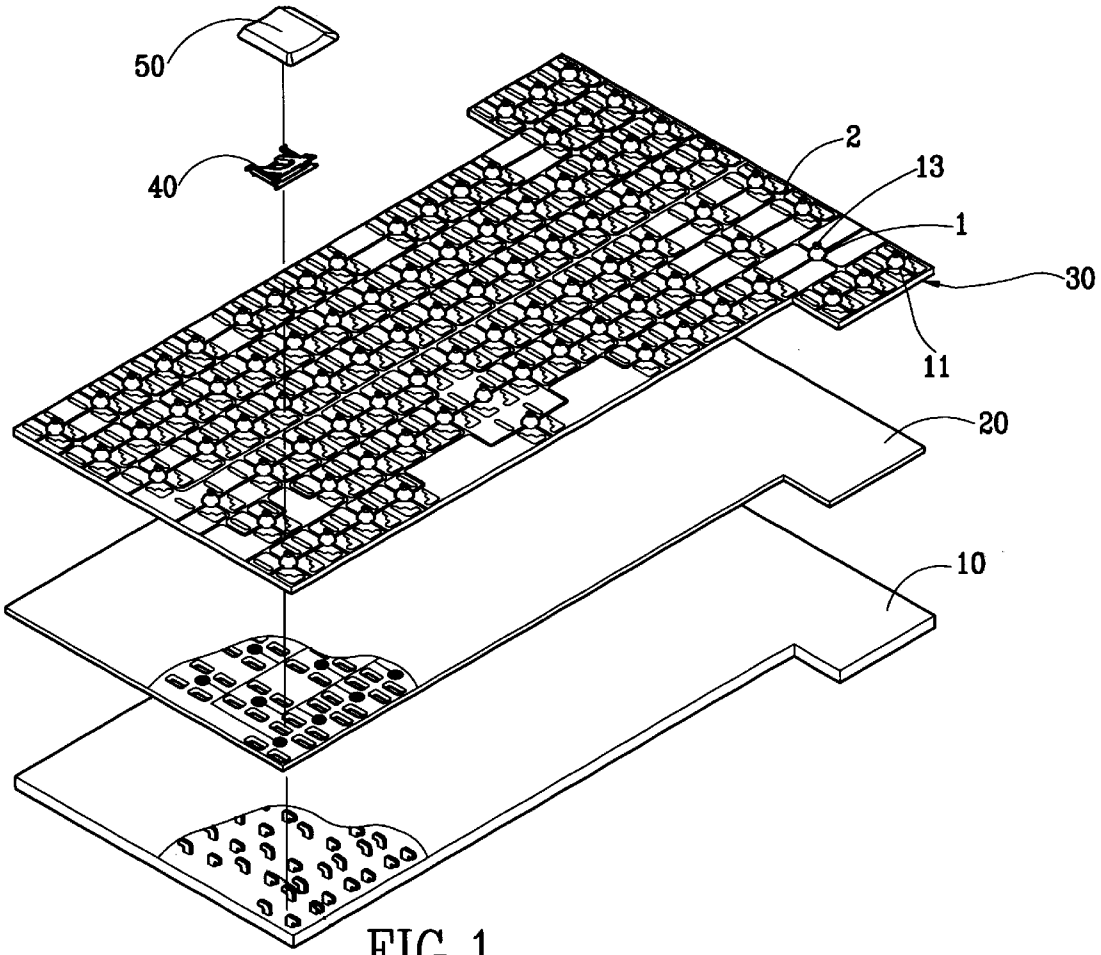
FIG. 1 is the exploded diagram of the invention.
Figure 2:
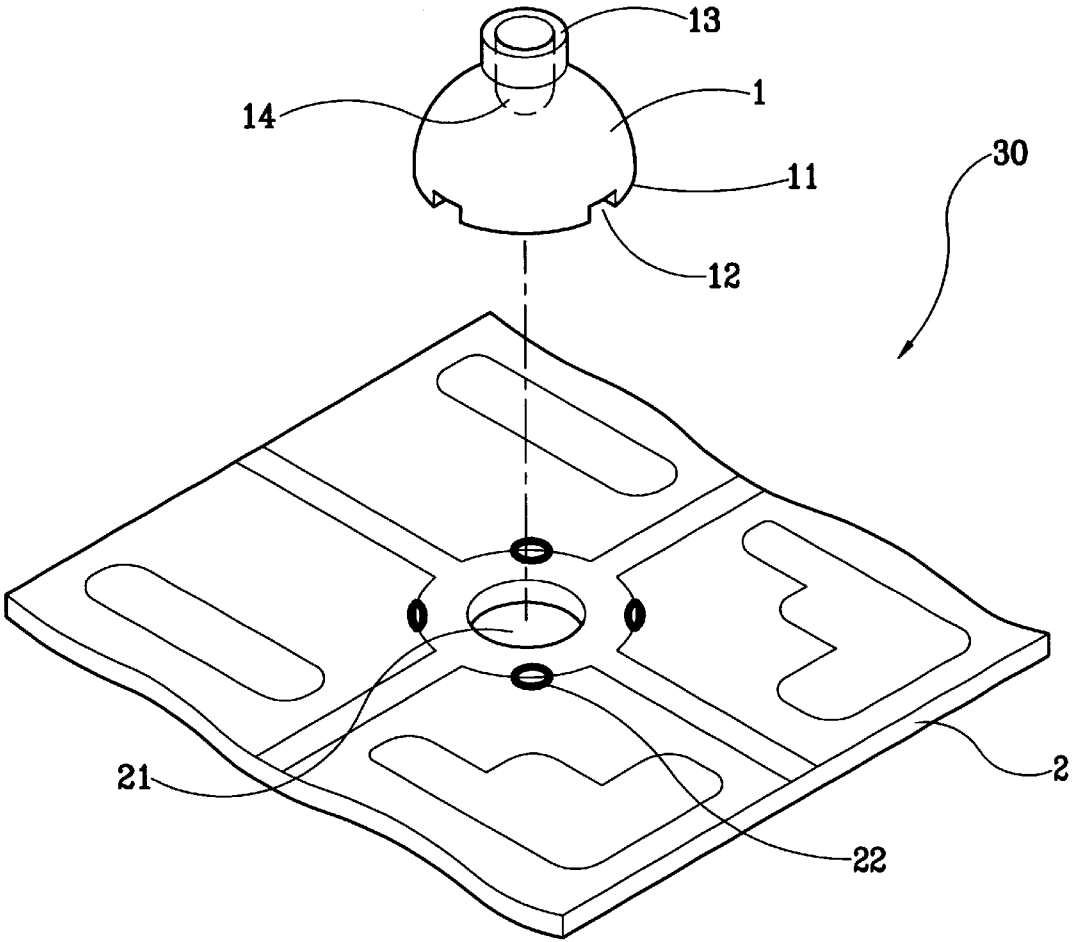
FIG. 2 is a view of partial part taken from FIG. 1.

As shown in FIGS. 1 and 2, the inventive structure is an elastic and actually-activated structure, and applicable to computer keyboards. The keyboard comprises a bottom plate 10, a conductive film 20, an elastic and tactually-activated structure 30, and a frame 40 and a cap 50 for each keyswitch. The inventive elastic and tactually-activated structure 30 comprises a domeshaped elastic member 1 for each keyswitch, each elastic member 1 having a plurality of vent holes 12 arranged on the bottom lateral side 11 of the elastic member 1 and separated by a predetermined distance. The structure 30 further comprises a hard film 2 which has a plurality of openings 21, each corresponding to a keyswitch portion. Each elastic member is positioned over a respective opening 21.

As shown in FIG. 2, in this embodiment, adhesive 22 is applied to the hard film 2 by mesh-printing. Then a vacuum process is used_to attach the elastic member 1 to the hard film 2. The location where the adhesive 22 is applied corresponds to where the elastic member 1 is not provided with vent holes 12.

In this invention, the elastic and tactually-activated structure 30 is placed between the conductive film 20 and the cap 50 when assembling the computer keyboard. At this time, the cap 5 is placed upon the end 13, having a smaller diameter, of the elastic member 1. When the cap 5 is depressed, the elastic member 1 is accordingly compressed such that the bump 14 of the elastic member 1 passes through the opening 21 of the hard film 2 and touches the contact circuit on the conductive film 20. The keyswitch therefore forms a closed circuit. The elastic member 1 is provided with vent holes 12, therefore external air will flow into the elastic member 1 through the vent holes 12, when the cap 50 is released from pressing. The elastic member 1 then is restored to its original shape for the next operation.

Figure 3:
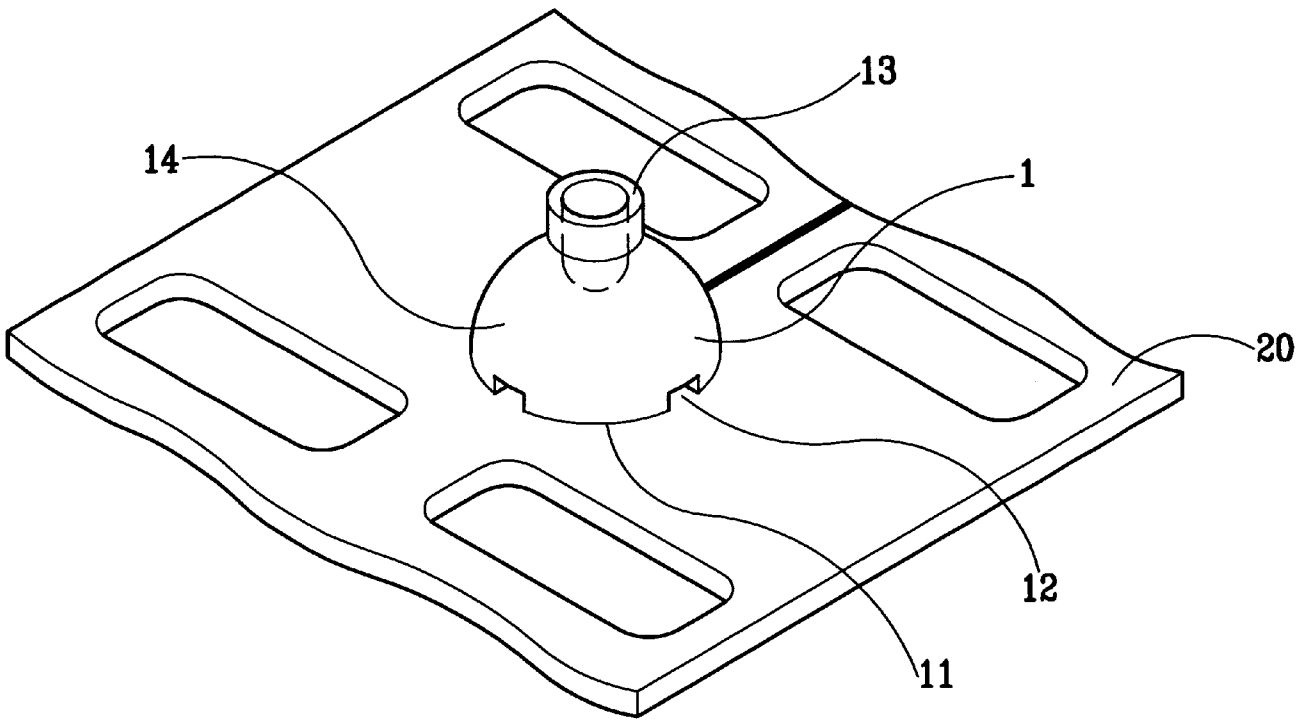
FIG. 3 shows another embodiment of the invention.
Figure 4:
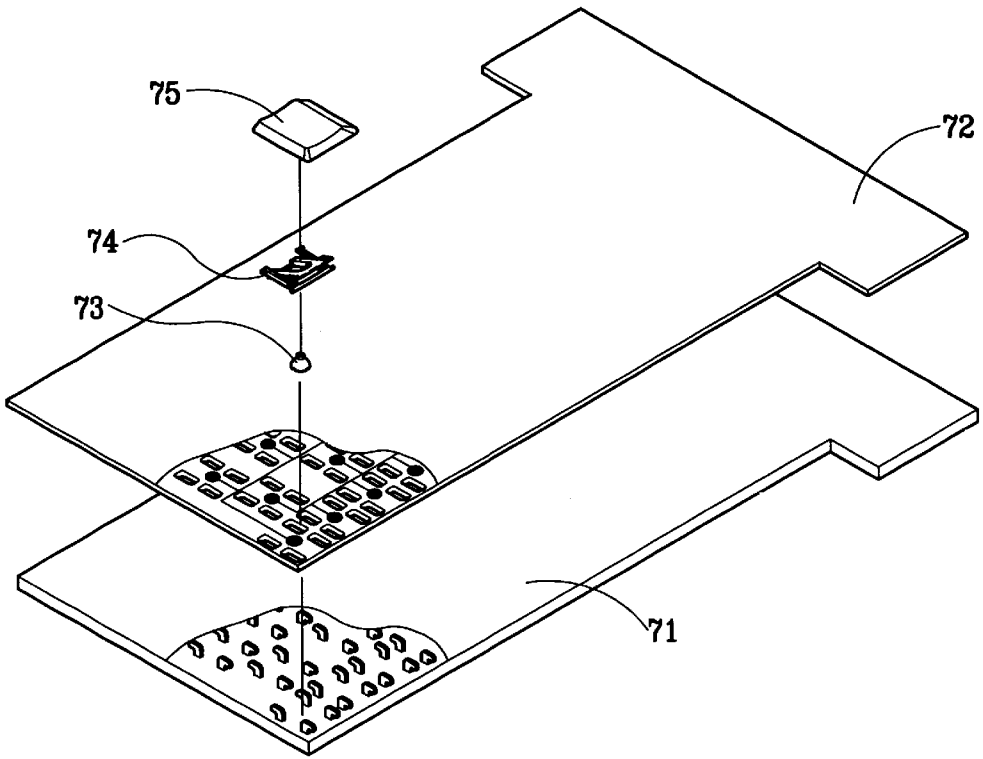
FIG. 4 PRIOR ART
FIG. 4 shows the exploded view of a conventional structure.
Figure 5:
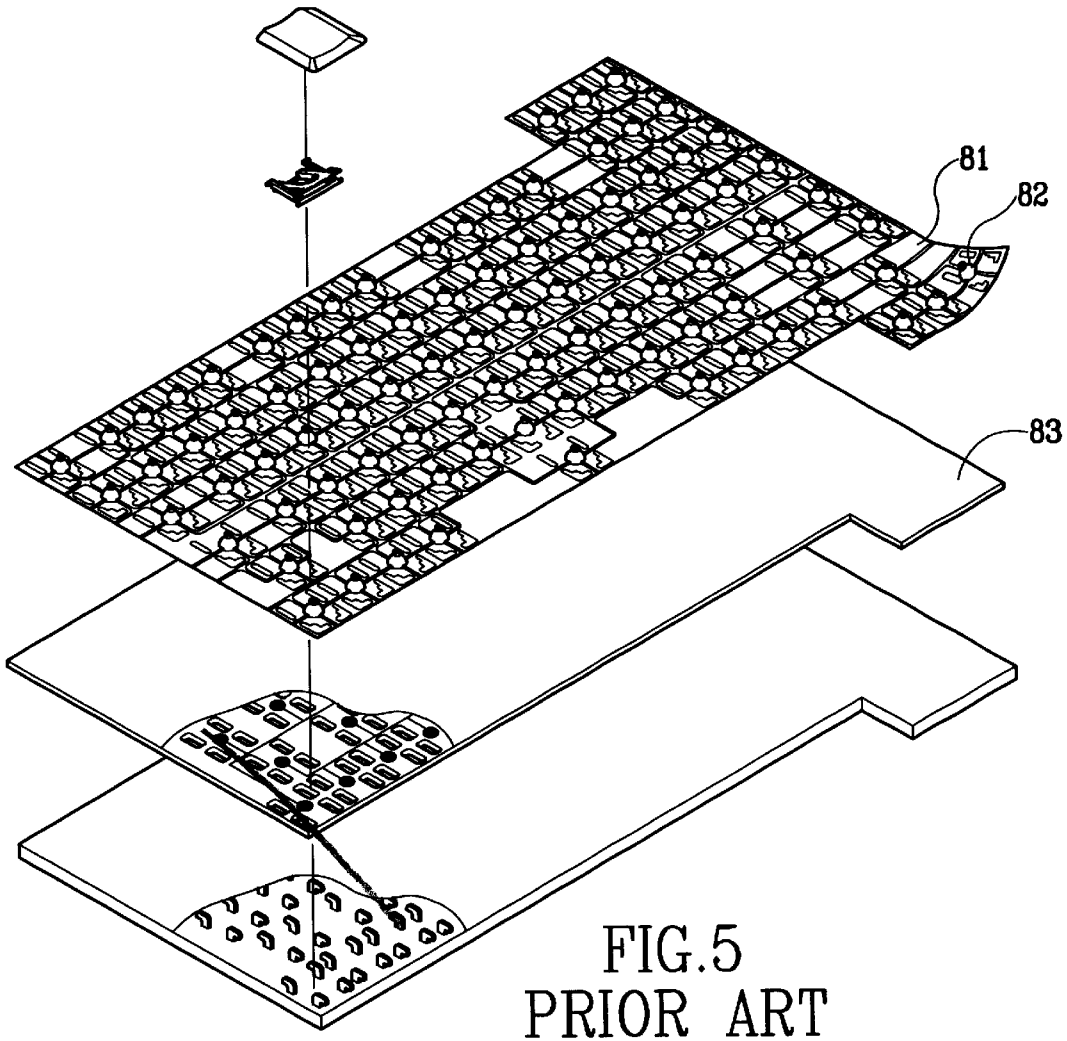
FIG.5 PRIOR ART
FIG. 5 shows the exploded view of another conventional structure.

As shown in FIG. 3, this figure depicts another embodiment of the present invention. The conductive film 20 also adopts hard material such that the elastic member 1 can be directly attached on the conductive film 20. The hard film 2 can be eliminated, whereby the height of the key is reduced and the assembling process is simplified.

In the present invention, the elastic member 1 is directly attached on the hard film 2, thus simplifying the assembling process and preventing the random bounce of the elastic and tactually-activated structure 30. Moreover, the elastic and tactually-activated structure is applicable to various type of keyboard, the cost is reduced to enhance competition.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. An elastic and tactually-activated structure of a keyboard, said structure comprising:

a bottom plate;

a conductive film overlaid on said bottom plate;

a hard film having a plurality of openings formed therethrough in correspondence to locations of keys of said keyboard, said hard film being overlaid on said conductive film;

a plurality of dome-shaped elastic members mounted to said hard film in respective correspondence with said plurality of openings thereof, each of said elastic members having opposing top and bottom ends, said bottom end having a plurality of vent openings formed radially therethrough in angularly spaced relationship;

a plurality of key caps respectively disposed on said top end of said plurality of elastic members; and, a plurality of frames respectively coupled between said bottom plate and said plurality of key caps.

2. The structure as in claim 1, further comprising an adhesive applied on said hard film in respective correspondence with portions of said bottom ends of said elastic members respectively disposed between said vent openings by mesh-printing.

* * * * *